US008360435B2

(12) United States Patent
Dayal et al.

(10) Patent No.: US 8,360,435 B2
(45) Date of Patent: Jan. 29, 2013

(54) SYSTEM AND METHOD FOR PROVIDING A TABLE GAME

(75) Inventors: Aditya Dayal, Sunnyvale, CA (US); Tom Grimm, Napa, CA (US)

(73) Assignee: ThrowMotion, Inc., Sunnyvale, CA (US)

( * ) Notice: Subject to any disclaimer, the term of this patent is extended or adjusted under 35 U.S.C. 154(b) by 337 days.

(21) Appl. No.: 12/630,736

(22) Filed: Dec. 3, 2009

(65) Prior Publication Data

US 2010/0133746 A1 Jun. 3, 2010

Related U.S. Application Data

(60) Provisional application No. 61/200,874, filed on Dec. 3, 2008.

(51) Int. Cl.
*A63F 7/06* (2006.01)
*A63F 7/20* (2006.01)

(52) U.S. Cl. ..... 273/317.7; 273/317.9; 273/108.31; 273/119 R; 273/123 R; 273/461

(58) Field of Classification Search ..... 273/108–129 W, 273/317.6–317.9, 237, 238, 259, 277, 461
See application file for complete search history.

(56) References Cited

U.S. PATENT DOCUMENTS

| | | | | | |
|---|---|---|---|---|---|
| 861,841 | A | * | 7/1907 | Heitmann | 273/317.7 |
| 968,249 | A | | 8/1910 | Meeker | |
| 983,250 | A | * | 1/1911 | Porter | 273/317.7 |
| 1,008,898 | A | * | 11/1911 | Fulton | 273/108.31 |
| 1,329,291 | A | | 1/1920 | Chapman | |
| 1,621,230 | A | | 3/1927 | Barr | |
| 1,626,778 | A | * | 5/1927 | Barker | 273/108.31 |
| 2,008,052 | A | * | 7/1935 | Walker | 273/317.7 |
| 2,075,960 | A | * | 4/1937 | Reichel | 273/108.31 |
| 2,233,685 | A | | 3/1941 | Simmons | |
| 2,362,188 | A | * | 11/1944 | Clark | 273/317.7 |
| 2,462,170 | A | * | 2/1949 | Dube | 273/108.32 |
| 2,775,457 | A | | 12/1956 | Galbos | |
| 3,009,452 | A | | 11/1961 | Barber et al. | |
| 3,091,459 | A | | 5/1963 | Lindman | |
| 3,730,525 | A | | 5/1973 | Maeda | |
| 3,814,425 | A | * | 6/1974 | Kanefield et al. | 273/108.31 |
| 3,879,037 | A | * | 4/1975 | Cooke | 273/108.31 |
| 3,883,139 | A | * | 5/1975 | Morrison | 273/108.31 |
| 4,065,130 | A | * | 12/1977 | Geraci | 273/238 |
| 4,179,123 | A | | 12/1979 | Tsukuda | |
| 4,216,961 | A | * | 8/1980 | McQuillan | 273/108.31 |
| 4,324,402 | A | | 4/1982 | Klose | |
| 4,327,913 | A | * | 5/1982 | Bock | 273/317.7 |
| 4,877,244 | A | * | 10/1989 | Burrows et al. | 273/108.31 |
| 4,976,434 | A | | 12/1990 | Wikner | |

(Continued)

OTHER PUBLICATIONS

PCT/US2009/066650—Search Report, Jan. 26, 2010.

*Primary Examiner* — Sebastiano Passaniti
(74) *Attorney, Agent, or Firm* — King & Spalding LLP; Sanjeet Dutta

(57) ABSTRACT

A system and method for providing a table game are disclosed. According to one embodiment, an apparatus comprises a playing field, a ball launcher mechanism launching a ball into the playing field, and the ball launcher mechanism allows a first player to select one or more attributes affecting a ball trajectory. The apparatus further comprises a ball striker mechanism controlling a ball striker. The ball striker placed at a distance from the ball launcher mechanism in the playing field has a bat to hit a ball launched by the ball launcher mechanism and is controlled by a second player. One or more sensors are placed in predetermined locations in the playing field. The electrical signals generated by the one or more sensors are used to update a status of a game.

25 Claims, 9 Drawing Sheets

U.S. PATENT DOCUMENTS 5,060,945 A 10/1991 Irvine
5,125,658 A 6/1992 Francis
5,409,221 A 4/1995 Chon
5,533,722 A 7/1996 Lu
5,655,767 A 8/1997 Francis et al.
5,700,008 A * 12/1997 Lawlor et al. ..... 273/118 A
6,186,133 B1 * 2/2001 Battersby et al. ..... 124/78
6,286,832 B1 9/2001 Willers
6,461,237 B1 10/2002 Yoshinobu et al.
6,533,272 B2 3/2003 Hylak et al.
6,561,511 B1 5/2003 Vaysberg et al.
6,585,269 B1 * 7/2003 Lee ..... 273/317.7
6,695,308 B2 * 2/2004 Hylak et al. ..... 273/108.31
6,805,348 B1 10/2004 Chen
7,207,564 B2 * 4/2007 Bedford et al. ..... 273/317
7,325,803 B1 2/2008 Miranda
7,691,012 B2 * 4/2010 Cucjen et al. ..... 473/422
2001/0030392 A1 * 10/2001 Huang ..... 273/121 A

* cited by examiner

SYSTEM AND METHOD FOR PROVIDING A TABLE GAME

The present application claims the benefit of and priority to U.S. Provisional Patent Application Ser. No. 61/200,874 filed on Dec. 3, 2008, and is hereby incorporated by reference.

FIELD

The present application relates to a game system. More particularly, the present invention is a system and method for providing an electromechanically controlled table game.

BACKGROUND

Table games refer to interactive games played by one or more players on a raised platform (or table). Table games may be played indoors or outdoors. Exemplary table games include table tennis, pool, billiards, foosball, and air hockey.

Cricket is a popular sport in India, the United Kingdom, Australia, the Caribbean, and South Africa and is rapidly gaining popularity in other countries. A few cricket table games or board games are currently available but the existing games do not provide realistic physical actions or realistic ball dynamics, hence they do not offer game players the reality and the excitement of a real game of cricket. For example, Wicketz is a cricket board game published by RDA Marketing of the United Kingdom that simulates pitching of a ball with a spinning bowling indicator. A batsman's stroke of a bat is determined by picking up a card.

Another example of a cricket board game is Super Cricket published by Toy Brokers Limited of the United Kingdom. In Super Cricket, a spring-loaded bowler rolls a ball on the surface of the game table. A batsman hits the rolled ball while keeping the bat in contact with the surface of the game table. None of these board games provides the reality of a real cricket game.

SUMMARY

The present disclosure includes methods and apparatuses for providing a table game. According to one embodiment, an apparatus comprises a playing field, a ball launcher mechanism launching a ball into the playing field, and the ball launcher mechanism allows a first player to select one or more attributes affecting a ball trajectory. The apparatus further comprises a ball striker mechanism controlling a ball striker. The ball striker placed at a distance from the ball launcher mechanism in the playing field has a bat to hit a ball launched by the ball launcher mechanism and is controlled by a second player. One or more sensors are placed in predetermined locations in the playing field. The electrical signals generated by the one or more sensors are used to update a status of a game.

The above and other preferred features, including various novel details of implementation and combination of elements, will now be more particularly described with reference to the accompanying drawings and pointed out in the claims. It will be understood that the particular methods and apparatuses are shown by way of illustration only and not as limitations. As will be understood by those skilled in the art, the principles and features explained herein may be employed in various and numerous embodiments.

BRIEF DESCRIPTION OF THE DRAWINGS

The accompanying drawings, which are included as part of the present specification, illustrate the presently preferred embodiment of the present invention and together with the general description given above and the detailed description of the preferred embodiment given below serve to explain and teach the principles of the present invention.

Figure 1A:
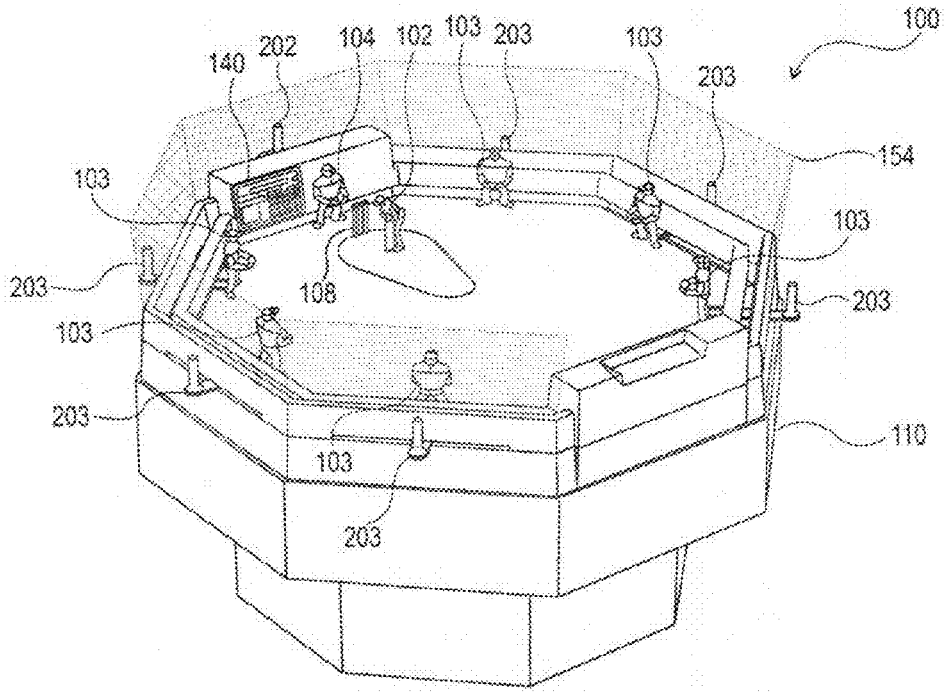
FIG. 1A illustrates an exemplary cricket table game, according to one embodiment.

It should be noted that the figures are not necessarily drawn to scale and that elements of structures or functions are generally represented by reference numerals for illustrative purposes throughout the figures. It also should be noted that the figures are only intended to facilitate the description of the various embodiments described herein. The figures do not describe every aspect of the teachings described herein and do not limit the scope of the claims.

DETAILED DESCRIPTION

An electromechanically controlled table game is disclosed. According to one embodiment, the table game comprises a playing field, a ball launcher mechanism that launches a ball into the playing field, a ball striker mechanism distantly placed from the ball launcher mechanism in the playing field, and optionally one or more ball interceptor (fielder) mechanisms. The ball launcher mechanism determines one or more attributes with which a ball is launched and is controlled by a first player. The ball striker mechanism controls a ball striker having a bat to hit a ball launched by the ball launcher mechanism and is controlled by a second player. The ball interceptor mechanisms are used to stop or catch balls that are hit by the ball striker mechanism, and may be controlled by additional players. The table game further comprises one or more sensors placed in predetermined locations in the playing field. The one or more sensors generate electrical signals upon detection of the ball in the predetermined locations in the playing field. Additional sensors may be located around the playing field. The table game further includes a control circuit board containing a microcontroller or microprocessor to receive and process the electrical signals from the one or more sensors. The microcontroller determines one or more events using the electrical signals provided by the one or more sensors and updates the status of the table game.

In the following description, for purposes of clarity and conciseness of the description, not all of the numerous components shown in the schematic are described. The numerous components are shown in the drawings to provide a person of ordinary skill in the art a thorough enabling disclosure of the present invention. The operation of many of the components would be understood to one skilled in the art.

Each of the additional features and teachings disclosed herein can be utilized separately or in conjunction with other features and teachings to provide the present table game. Representative examples utilizing many of these additional features and teachings, both separately and in combination, are described in further detail with reference to the attached drawings. This detailed description is merely intended to teach a person of skill in the art further details for practicing preferred aspects of the present teachings and is not intended to limit the scope of the claims. Therefore, combinations of features disclosed in the following detailed description may not be necessary to practice the teachings in the broadest sense and are instead taught merely to describe particularly representative examples of the present teachings.

Moreover, the various features of the representative examples and the dependent claims may be combined in ways that are not specifically and explicitly enumerated in order to provide additional useful embodiments of the present teachings. In addition, it is expressly noted that all features disclosed in the description and/or the claims are intended to be disclosed separately and independently from each other for the purpose of original disclosure, as well as for the purpose of restricting the claimed subject matter independent of the compositions of the features in the embodiments and/or the claims. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help understand how the present teachings are practiced but are not intended to limit the dimensions and the shapes shown in the examples.

According to one embodiment, a method of ball delivery and playing a table game is provided. A ball is launched from a ball launcher mechanism towards a ball striker mechanism from approximately 6-10 inches above the surface of the game table 110. The ball speed, the location where the ball bounces, the ball spin, and/or direction of the ball are controlled by the ball launcher mechanism. The ball launcher mechanism simulates a bowler of a real cricket game. The ball striker mechanism simulates the shape and motion of a real cricket batsman. The ball launcher and ball striker mechanisms provide a unique cricket experience to the players of the game.

The table game provides a realistic three-dimensional emulation of the game of cricket. According to one embodiment, a ball is launched into the air towards the batsman or ball striker, from or above the floor of the table. The ball travels through the air over a significant portion of the playing surface, and usually reaches the batsman after one bounce or full toss. The bowler controls the speed and target location of the ball as well as the spin. The trajectory and bounce of the ball allows the batsman to experience a life-like ball delivery and hit the ball along or above the surface of the playing field. The batsman mechanism provides a hitting action closely resembling how the ball is hit in a real game of cricket. Sensors detect the ball at various stages and locations and provide signals for determining events, such as scoring and outs. The events are announced via audio and visual mechanisms to the players creating a real multi-media game playing experience.

According to one embodiment, the table game disclosed herein is adapted to other ball games such as baseball or softball that require a pitcher (or a ball launcher) and a batter (or a ball striker). Alternatively, each of the ball launcher mechanism and the ball striker mechanism, individually or in combination, may be used in other ball games. For example, the ball striker mechanism may be used to strike a golf ball in a golf table game. It is appreciated that the presently described table game or individual part(s) of the table game may be applied to other ball games without deviating from the scope of the present subject matter.

Figure 1B:
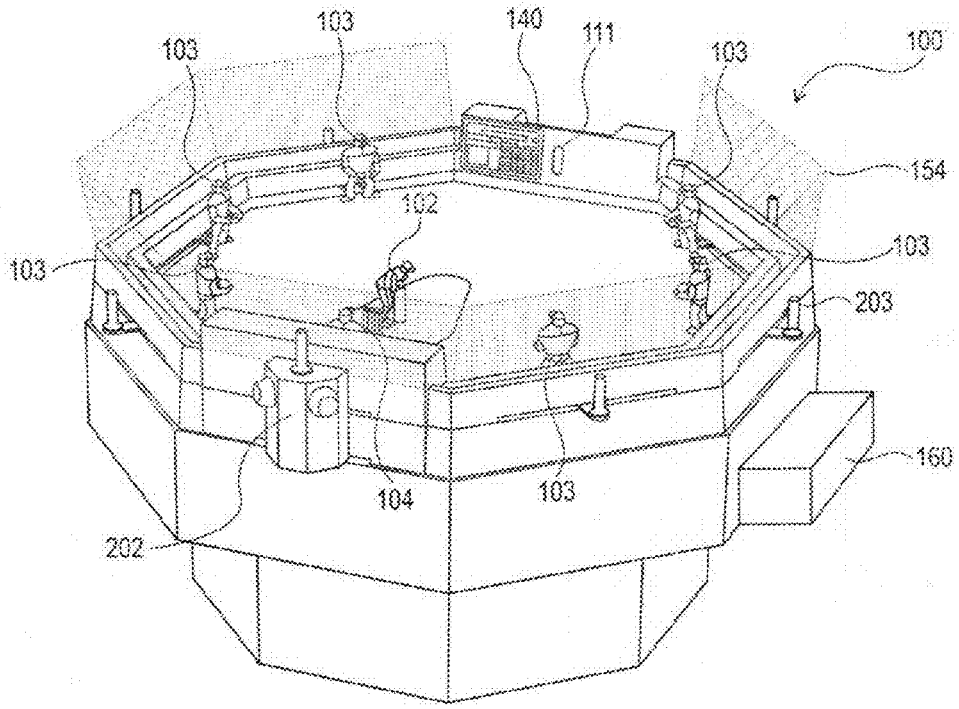
FIG. 1B illustrates another view of an exemplary cricket table game, according to one embodiment.

FIGS. 1A and 1B illustrates an exemplary cricket table game, according to one embodiment. A batsman 102, One or more fielders 103, and a wicketkeeper 104 are positioned on a game table 110. A bowler does not physically appear as other players such as batsman 102, or fielders 103. A bowler is represented by a ball launcher mechanism 201 from which a ball is bowled or pitched. A ball 105 is launched from the ball launcher mechanism 201, and batsman 102 hits the launched ball 105. The fielders 103 catch or stop the hit ball 105 from reaching the boundary of the game table 110.

According to one embodiment, the cricket game 100 is played by two or more players simultaneously. Each player may take turns controlling the ball launcher mechanism 201, the batsman control 202, or one or more fielder controls 203. The game may be played individually or with teams of individuals.

The table game 100 provides realistic three-dimensional actions of a cricket game. A ball 105 is launched from the ball launcher mechanism 201 towards the batsman 102. The player controlling the ball launcher mechanism 201 controls the speed, trajectory, and spin of the ball 105 using the ball launcher user interface 401. A ball 105 following a trajectory in a three-dimensional space provides more reality in game play than a ball rolled on a surface of a table. The ball 105 may travel above the surface of the game table 110 or a significant portion thereof between the ball launcher mechanism 201 and the batsman 102 and/or bounce off the surface of game table 110. The player controlling the batsman 102 reacts quickly, defends the wicket 108, and hits the ball 105 in a manner that closely resembles a real cricket game, along or above the surface of the game table 110. The bowler tries to minimize runs scored by the batting team. The fielders 103 assist the bowler 102 in this effort by catching and/or fielding the hit ball 105. The batting team, including the batsman 102, tries to score as many runs as possible without getting out.

According to one embodiment, various sensors and actuators are employed in the table game. The sensors detect the motion and position of a ball, and a computer of the table game determines and updates the status of the game in response to the sensor's detection of the ball. The status of the game and scores are updated on display(s) 140 real time. A variety of sound effects may accompany visual indicators on the display(s) 140 to provide a realistic game playing experience.

In one embodiment, the sensors used to detect the presence of a ball are electromechanical or photosensitive sensors. For example, LED light sensors are used in the ball launcher mechanism 201, the drains 150, and the gutters 152 and 153. LED light sensors include a light emitter (LED) and a photosensitive sensor that detect the blockage of light as a ball passes between them. The collision of a ball to the wicket 108 or the lower body of the batsman 102 is detected by mechanical or electromechanical switches such as snap action hinged switches or roller hinged switches. It is appreciated that various types of sensor mechanisms such as capacitive sensors, contact sensors, proximity sensors, motion sensors, and accelerometers may be used without deviating from the scope of the present subject matter.

According to one embodiment, the game table 110 is an octagonal shape. The size of the game table 110 is determined in order to have proper spacing among the players controlling the ball launcher mechanism 201, the batsman control 202 and the fielder controls 103. For example, the width of the game table 110 is 60 inches, and the height of each player is approximately 7 inches. The size of the ball 105 may be determined to be proportional to other dimensions of table 110 or the players and/or the equipment of the players. For the above example, a plastic ball having a diameter of 0.75 inch is used.

Figure 2:
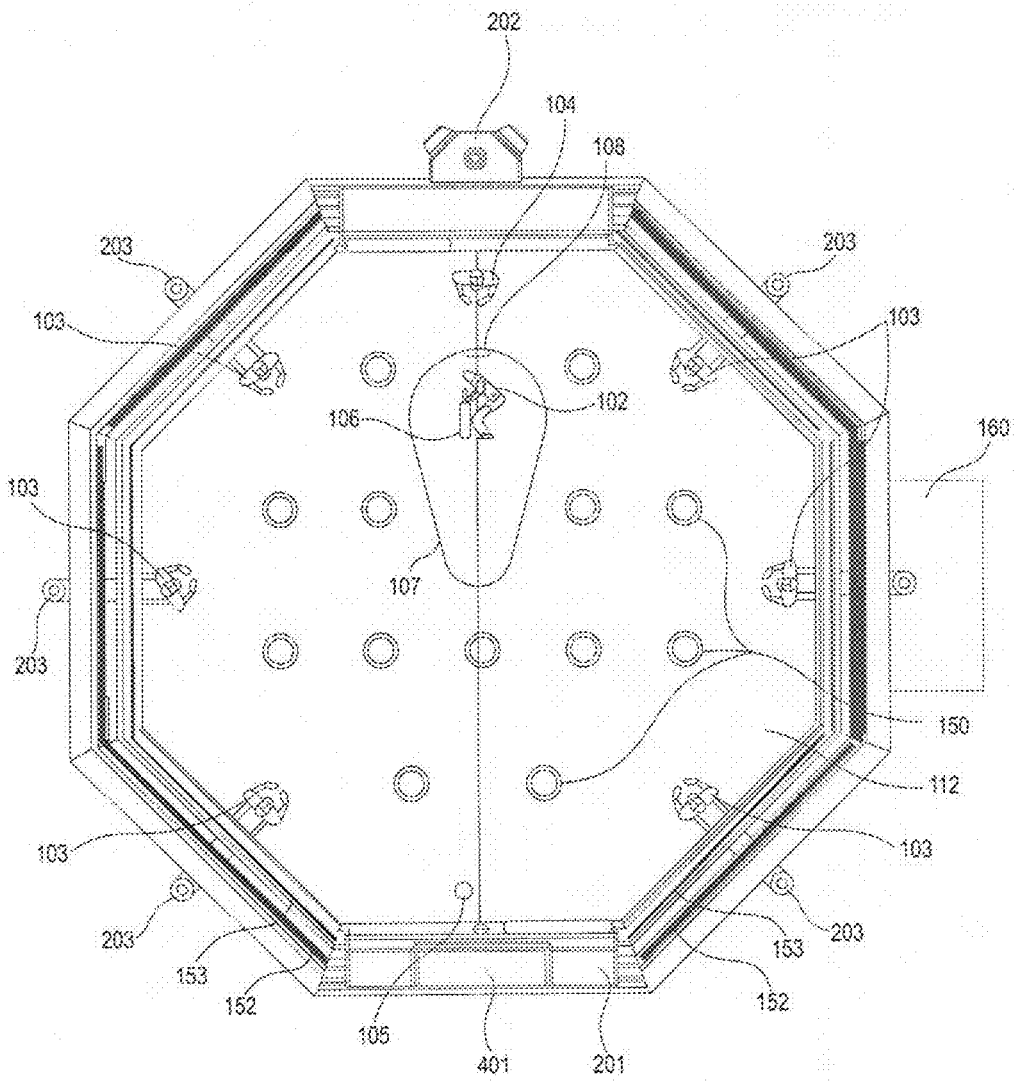
FIG. 2 illustrates the top view of an exemplary cricket table game, according to one embodiment.

FIG. 2 illustrates the top view of an exemplary cricket table game, according to one embodiment. On the playing field of the game table is an area 107 called a "pitch." The pitch 107 refers to the region on the playing field around the batsman 102 where a launched ball generally bounces. According to one embodiment, the surface of the pitch 107 is made of a material having a texture and rigidity to allow the ball 105 to bounce as in a real cricket game. The pitch 107 may be of any shape, for example, a rectangle, an ellipse, or a circle. The inner part of the playing field surrounding the pitch is an infield, and the outer area 112 surrounding the infield and extending to the boundary of the field is an outfield.

According to one embodiment, the playing surface may be a part of a customized table. Alternatively, the playing surface may be removable and foldable so it can be placed on an existing table of a comparable size. According to another embodiment, the table game is provided with a playing surface and the necessary components configured for placement atop an existing table or platform. According to yet another embodiment, the ball launcher mechanism, ball striker mechanism, and/or other components of the table game are provided separately and are assembled onto or on the perimeter of the playing surface to provide the table game.

The surface of game table 110 may be covered with a green felt, carpet or similar suitable material that simulates a real playing field or lawn. The material may be carefully selected to allow for a given amount of bounce and control on a ball 105. It is appreciated that a variety of materials, textures, shapes, and colors may be used for covering the playing field of the game table 110 to achieve functional and/or aesthetic purposes. In one embodiment a green outdoor carpet is used to cover the playing surface.

The ball launcher mechanism 201 launches a ball 105 with certain attributes, such as speed, angle of launch, spin and direction towards the batsman 102. According to one embodiment, the ball launcher mechanism 201 is an electromechanical device containing two wheels 455 driven by motors 453 that are controlled by microcontroller to launch the ball 105 in a precise manner with the above mentioned desired attributes.

The ball 105 may reach the batsman 102 without bouncing or after bouncing on the pitch 107. The ball launcher mechanism 201 allows the player to give a desired amount of spin to the ball 105, such that the ball 105 deviates toward the left or right relative to the wicket 108 to confuse the batsman 102. Enabling a spin on ball 105 adds another level of resemblance to a real cricket game where spin bowling is commonly used. The allowable ranges of each degree of freedom of the ball 105 may be programmed into the microcontroller.

The player controlling the ball launcher mechanism 201 selects desired attributes of the ball trajectory via a ball launcher user interface 401. According to one embodiment, the attributes of the ball 105 are independently specified, for example, spin, speed, direction, and launch angle. Alternatively, the player may be given an option to randomize the attributes of the ball 105 to such a degree that the ball launcher mechanism 201 automatically determines the type of ball delivery within an acceptable range of possibilities. Controlling the trajectory of a ball 105 accurately and repeatably with a number of variations is essential for a predictable game play. Simplifying bowling by allowing a player to select a ball trajectory without calculating the launch angle and launch speed for specific trajectory is essential for ease of use of the ball launcher mechanism 201. The selection of ball attributes via the ball launcher user interface 401 is sent to a microcontroller to calculate the speed and launch angle of a ball and to provide appropriate electrical signals to the motors and/or actuators. According to one embodiment, a feedback mechanism is incorporated in the ball launcher mechanism 201 to achieve and maintain accuracy of the motor speed over a long period of time.

The microcontroller of the ball launcher mechanism 201 may be programmed to refer to a look-up table to determine the electrical output required to launch a ball with specific user-selected attributes.

According to one embodiment, the launch angle of the ball launcher mechanism 201 is manually controlled. Alternatively, it can be controlled by a stepper or DC motor via an appropriate gear mechanism. Similarly, the direction of the ball launch (left or right) relative to the wicket may be controlled manually or by an electromechanical mechanism.

The ball launcher user interface 401 generates appropriate commands to launch a ball 105. The ball 105 is fed into the ball launcher mechanism 201 via an automatic or manual feeder mechanism (not shown) via the ball feeder tube 454. The feeder mechanism may be programmed to continuously provide balls 105 for batting practice or a game play. The ball launcher mechanism 201 decodes the player's inputs from the ball launcher user interface 401 and generates appropriate commands to launch the ball 105. According to one embodiment, the microcontroller of the ball launcher mechanism 201 enables it to automate and/or randomize a series of ball launches.

According to one embodiment, batsman 102 is mechanically or electromechanically controlled. The size of the bat 106 of the batsman 102 may be determined proportionally to the dimension of game table 110 or other players and/or the equipment of the other players. According to one embodiment, the batsman 102 stands 7 inches tall, and the bat 106 is 4 inches long and 1 inch wide. The batsman 102 is controlled by the batsman control 202. The functionality of the batsman control 202 is intuitive to provide the player with a sense that he/she is actually manipulating a bat in a real cricket game. The batsman control 202 enables the player to move the batsman 102 in the game in a three-dimensional space: (1) the batsman 102 and bat 106 can rotate about an axis that runs vertically through the batsman 102; (2) the batsman 102 can translate left and right to cover the width of the pitch; and (3) the bat 106 swings about a horizontal axis to strike a ball 105.

According to one embodiment, each of the fielders 103 are mechanically or electromechanically controlled. One player may control one or more fielders 103 via a coupling mechanism connecting the one or more fielders 103. The fielding team may strategically place the fielders 103 to catch or stop a hit ball 105 so that runs awarded to the batting team are minimized. A fielder 103 can move left and right within the confinement of the fielder control 203 to cover the entire section or a portion of each octagon segment of game table 110. Although six fielders 103 are shown in the present example, the numbers of fielders 103 may vary depending on the size and shape of game table 110. To add reality to the game, fielders 103 resemble a real player, and their dimensions are chosen to provide a cross-sectional area that can stop or catch hit balls 105 by the batsman 102.

According to one embodiment, one or more drains 150 and/or a gutter 153 are provided alongside the perimeter of the game table 110 or on the surface of the game table 110. An additional gutter 152 is located outside of gutter 153. The balls that are played are collected through the drains 150 or gutter 152 or 153 to continue the table game without human interference. Sensors detect the presence of a ball as it falls into any of the drains or gutters.

According to one embodiment, there are gutters two gutters 152 and 153 to detect and collect balls. Any ball 105 that is hit and reaches a boundary wall in one or more bounces without being caught by fielders 103 scores four runs. The gutter 153 is placed on the outskirts of the playing field to collect the ball that scored four runs. The boundary wall or barrier outside the perimeter of the playing field directs balls that are hit towards the perimeter of the playing field into the gutter 153. The ball sensor in the gutter 153 senses a ball 105 and provides a corresponding electronic signal to the main computer 160. The program of the main computer 160 interprets the electronic signal as an event, provides audio and visual feedback on the event, and updates the scoreboard accordingly. A ball 105 that flies over the boundary wall without a bounce is caught by net 154, enters the gutter 152, and scores six runs. Net 154 may be replaced or supplemented with other types of barriers to catch the balls flying over the boundary wall. Upon sensing a ball, the sensor of the gutter 152 provides a corresponding electronic signal to the main computer 160.

The ball 105 that impacts a fielder 103 may (a) bounce off the fielder 103 and then roll back into the boundary gutter 153 or any of the other drains 150 on the surface of the playing field, (b) bounce off the fielder and fall almost immediately into one of the gutters 152 or 153 or one of the drains 150, or (c) fall through the arms of the fielder 103, triggering the ball sensor contained therein. In the event of (a) and (b), if the time taken for the ball 105 to fall through the gutter or drain exceeds the time for which the ball is in-play, the fielder 103 is determined to have fielded the ball 105, and no runs are scored. If the ball falls through one of the drains 150 or gutters 152 or 153 while still in-play, the batsman 102 scores the runs associated with the drain 150 or the gutter 152 or 153. Finally, in the event of (c), the fielder 103 caught the ball 105, and the batsman 102 is called-out.

According to one embodiment, the fielders 103 may be made of an absorbent foam-like material so that a ball 105 that strikes the fielder 103 drops down close to, or in the arms of the fielder 103. If the ball 105 falls through the arms of a fielder 103 into the basket contained therein, the sensor(s) in the arms or basket of the fielder 103 detects the ball 105, and the batsman 102 is called out.

According to one embodiment, the game table 110 is a rectangular, hexagonal, or octagonal shape, but not limited thereto. The shape and/or dimensions of the game table 110 may vary depending on system configuration, complexity, the numbers of players, and/or similar factor& For example, the batsman 102 is placed 44 inches away from the ball launcher mechanism 201. In the example as shown in FIG. 1, the game table 110 is an octagonal shape for up to eight players (thus eight controls) for the ball launcher mechanism 201, the batsman 102, and the six fielders 103. Each player is placed at each of the eight sides of the octagon. According to one embodiment, the surface of the field is gradually down sloped toward the outfield 112 to provide a passive ball recovery mechanism. A played ball 105 rolls towards and falls into one of the drains or gutters and is returned to ball launcher mechanism 201. The ball that does not fall into one of the drains 150 or gutters 152 and 153 is manually removed from the playing field before the next play.

When a ball 105 is bowled, the cricket game 100 is in play. The sensors placed in the ball launcher mechanism 201 detect the launch of the ball 105, the speed of the ball, and/or other information. This the information is displayed or updated on the display(s) 140. The batsman 102 may choose to play the ball 105 or pass it. If the batsman 102 passes the ball, no run is scored. If the ball 105 hits the wicket 108 positioned behind the batsman 102, the batsinan 102 is out. The sensor placed in the wicket 108 detects if the batsman 102 is bowled out. This information is updated on display 140 optionally, along with associated audio or video effects.

The fielders 103 stop or catch played balls 105. In one embodiment, there are holes in the base of each fielder 103. Alternatively, there are gaps between the fielder 103's legs through which the stopped or caught balls are released into the inner boundary gutter 153. The gutter 153 serves as return paths for the caught balls 105. The arms of the fielder 103 may also be equipped with a sensor to detect a ball 105 that falls into them.

There are multiple ways of getting the batsman 102 out. First, when a launched ball 105 hits the wicket 108 either directly or after touching any part of the batsman 102 or bat 106, the batsman 102 is called out. If a ball 105 hit by the batsman 102 with the bat 106 or a launched ball that hits the upper body of the batsman 102 is subsequently caught by any fielders 103, the batsman 102 is also called out. This includes the six user-controlled fielders 103 and the wicketkeeper 104. The wicketkeeper 104 may be user-controlled using a dedicated controller (not shown) or any other player of the fielding team. The batsman 102 is also out if the ball 105 hits the batsman 102's lower body while the lower body is in front of the wicket 108. Small mechanical switches are placed in the leg of the batsman 102 to detect ball collisions with its lower body, according to one embodiment.

For each ball 105 being bowled and played, batsman 102 may score 0, 1, 2, 3, 4, or 6 points or runs. According to one embodiment, runs are counted and scored only within a predefined period (e.g., 3 seconds) after the ball is launched. During this time period, the ball is said to be in play. After the predefined period has elapsed, the ball 105 is considered dead, and no runs are scored. Four runs are scored if the ball, after being hit by the batsman 102, reaches the boundary gutter 153 while within the predefined in play period. Six runs are scored if the ball gets to the outer gutter 152 within the predefined in play period. The time-based rule ensures that a ball 105 that is, for example, manually recovered and dropped into one of the return holes does not result in any runs.

According to one embodiment, one or more drains 150 are marked with a number that is placed on the field or the fence of the game table 110. If a hit ball 105 lands on one of these drains 150 and falls into the corresponding drains 150, the batsman 102 scores the run(s) marked on the drain 150. Each drain 150 is equipped with a sensor to detect the ball 105 that falls into it, and provide an electronic signal to the main computer 160 of the cricket game 100.

The main computer 160 may be a dedicated processor with adequate memory and processing power to provide video and audio outputs and to read and record signals from the sensors. The main computer 160 may be an existing desktop or laptop computer that communicates in real time with a microcontroller circuit. According to one embodiment, the main computer connects and downloads game scores and results to a data server allowing players to compare their scores against other players.

Scores are updated automatically by the main computer 160 of the cricket game 100 using inputs from the various sensors and a timer that determines when the ball is in play. Runs may be scored when the ball falls into one of the gutters or the scoring drains within a specified amount of time as determined by the timer. Any events detected after the expiration of the timer do not result in runs or outs.

Scoring is automatically kept by the main computer 160 of the cricket table game 100 using various sensors and a timer. The sensors equipped throughout the game table 110 detect the presence of balls 105 and send electrical signals to the main computer 160. Events such as launching of the ball 105, hitting of the ball 105, ball catches and interceptions (by the fielders or the drains and targets), as well as the ball 105 striking the wicket or the batsman 102's lower body, are detected. The information is sent to the main computer 160, and the game status and scores are properly updated. The updated status and scores are displayed in real time on the display(s) 140.

Figure 3:
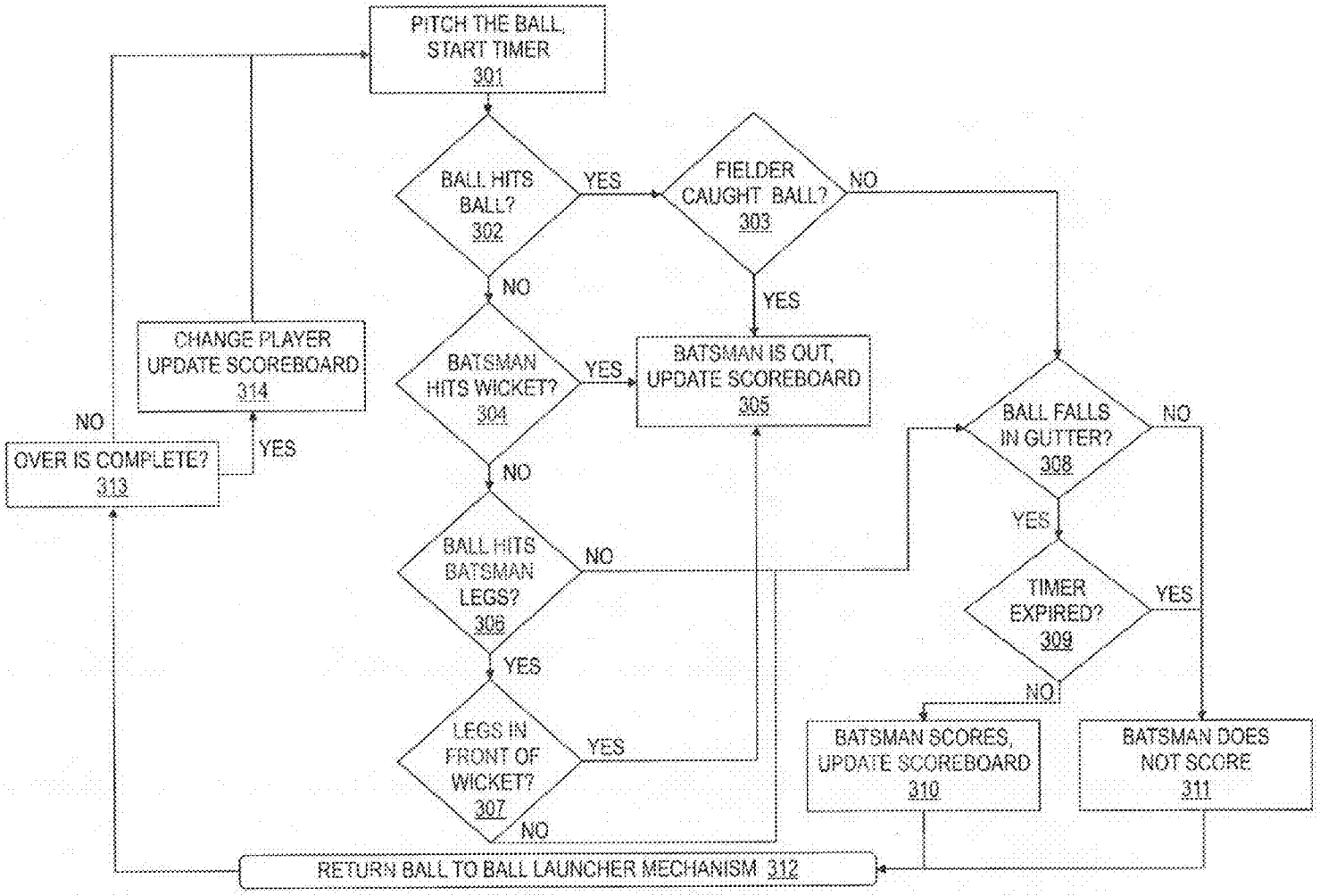
FIG. 3 illustrates an exemplary flow chart for an exemplary cricket game, according to one embodiment.

FIG. 3 illustrates an exemplary flow chart for an exemplary cricket game, according to one embodiment. The bowler selects the input parameters (e.g., speed, launch angle, spin) to change the control of a ball 105 being launched (301). The ball 105 is launched and the timer is started (301). The batsman 102 either hits the ball 105 or, intentionally or unintentionally misses the ball 105. If the ball 105 is not hit by the batsman 102's bat 106 but hits the wicket 108 instead (304), the batsman 102 is called out, and the status is updated (305). After the batsman 102 hits the ball 105 using the bat 106 (302), and the ball is caught by one of the fielders 103 or the wicketkeeper 104 the batsman is called out (303). If the hit ball 105 is not caught by any of the fielders 103 but falls into one of the drains 150, or gutters 152 or 153 (308), and the timer has not expired (309), the batsman scores the number of runs associated with the drain 150 or gutter 152 or 153 (310). If the timer has expired, or the ball does not fall into one of the drains 150 or gutters 152 or 153, the batsman does not score any runs (311).

If the ball hits the batsman 102's legs or lower body (306) and the legs (or lower body) are in front of the wicket (307), the batsman 102 is called out (305). If the ball does not hit the batsman 102's legs or lower body, or the legs and lower body are not in front of the wicket, the batsman is not out. If the ball subsequently falls into one of the drains 150, or gutters 152 or 153 (308), and the timer has not expired (309), the batsman 102 scores the number of runs associated with the drains 150 or gutters 152 or 153 (310). If the timer has expired or the ball does not fall into one of the drains 150 or gutters 152 or 153, the batsman 102 does not score any runs (311).

After a ball 105 is launched, there are three possible outcomes: (1) the batsman 102 is called out, (2) the batsman 102 is not out, but scores runs, and (3) the batsman 102 is not out and does not score any runs. Following any one of the above three outcomes, the ball 102 is considered to be dead or no longer in play. The ball 105 is returned to the bowler (309) through the drains and gutters. In alternative embodiments, additional outcomes are possible.

Figure 4:
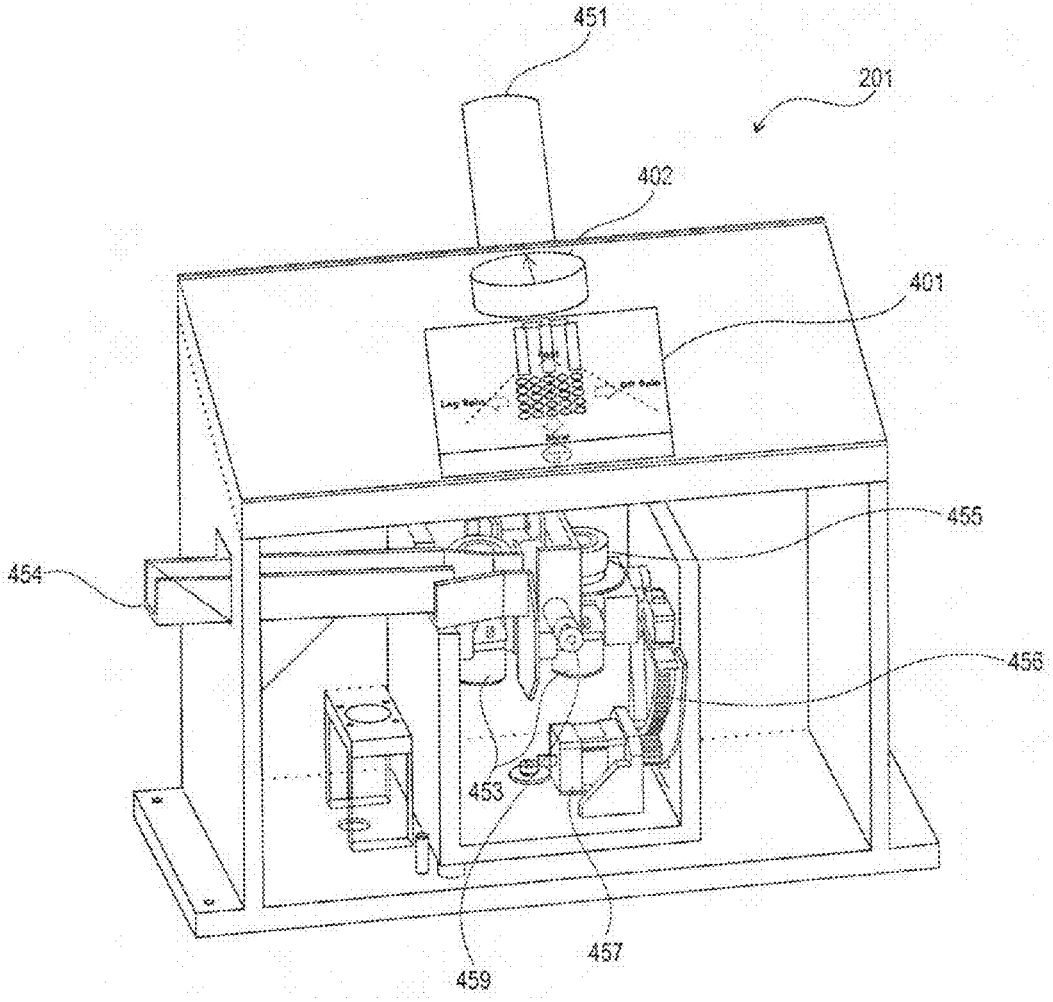
FIG. 4 illustrates an exemplary ball launcher mechanism, according to one embodiment.

FIG. 4 illustrates an exemplary ball launcher mechanism, according to one embodiment. The ball launcher mechanism 201 is attached to a side of the game table 100 designated for the bowler. The ball launcher mechanism 201 contains a ball feeder tube 454, a ball guide 458, wheels 455 attached to motors 453, a ball chute 451, and a solenoid 459. The wheels 455, motors 453 and ball chute 451 are collectively referred to as a launch assembly. The manually or automatically recovered balls 105 are fed to the ball launcher mechanism 201 through the ball feeder 454 one at a time. The ball is stored in the ball guide 458 until the player decides to launch the ball via the ball launcher user interface 401. Upon the player's input for launching a ball, a ball is positioned in front of the solenoid 459, and the ball is pushed by the solenoid 459 between the wheels 455 to propel the ball. In another embodiment, the ball is fed by gravity to the wheels 455. The launch angle of the ball 105 is adjusted manually or automatically by moving the launch assembly via a stepper or DC motor 457 coupled to the gear 456. The ball chute 451 may be hidden behind the slot 111 so that the batsman 102 is unable to predict the trajectory of the ball 105 when launched.

According to one embodiment, the outer surface of wheels 455 is made of a soft and/or compressible material to ease insertion of a ball therebetween and to impart spin on the ball. To impart force to a ball having a diameter of 0.75 inch, the wheels 455 are placed with a gap of approximately 0.625 inch that is narrower than the diameter of the ball. In one example, the wheels 455 are Lite Flite wheels made of foam rubber manufactured by Dave Brown Products, Inc. of Hamilton, Ohio. To impart a desired propelling and spinning property, the surface of the wheels 455 may be covered with appropriate material.

For a specified type and size of wheels 455 and ball 105, the speed of the ball 105 at launch is determined by the speed of the spinning wheels 455 coupled to the motors 453. In the present example, two motors are used to propel the ball 105 but additional motors may be added to supplement the control of the ball attributes. In one embodiment, the motors 453 are DC motors rated at approximately 5000 RPM. The speed of the motors 453 may be controlled by a microcontroller circuit using pulse width modulation (PWM). Alternatively, the motors 453 may be stepper or servo motors. Other launching mechanisms may also be used by replacing motors 453, or using the motors 453 in combination with other types of electronic and/or mechanical launching mechanisms, to change the attributes of the ball 105's trajectory.

The computer 160 may individually control the speed of the motors 453 so that a spin can be applied to the ball 105. The bigger the differential of the speed between the two motors 453, the more spin is applied to the ball 105. In one embodiment, the maximum spin is selected such that the ball moves approximately 4 inches left-to-right, as viewed by the bowler, after bouncing on the pitch 107. The amount of spin is determined to allow the player controlling the batsman 102 experience a realistic cricket game. The relative position and/or the gap between the motors 453 may be additionally controlled to change the attributes of spin applied to the ball 105. For example, a forward spin may be applied instead of a side spin by placing the two motors up and down instead of side by side as shown in FIG. 4. The surface of the wheels 455 may be treated or coated with different materials to change the attributes of the spin. Alternatively, the ball launcher mechanism 201 may employ a hydraulically-controlled or pneumatically-controlled launch mechanism or a simple mechanical launch mechanism instead of the electromechanically controlled mechanism shown in FIG. 4. It is appreciated that the exemplary ball launcher mechanism 201 illustrated in FIG. 4 is not considered to limit the present subject matter, and various launching mechanisms can be employed without deviating from the scope of the present subject matter.

Figure 5:
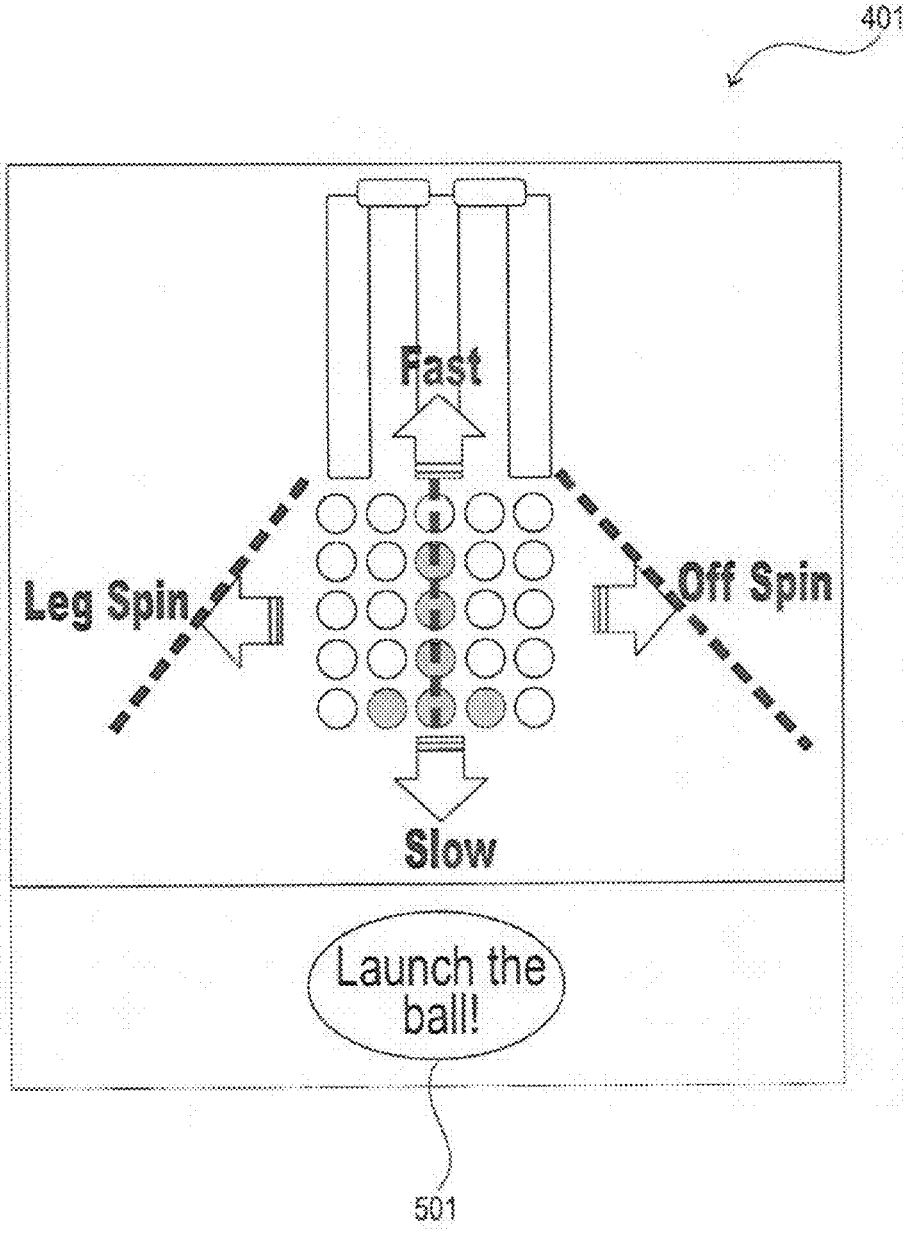
FIG. 5 illustrates an exemplary graphical user interface for a ball launcher mechanism, according to one embodiment.

FIG. 5 illustrates an exemplary graphical user interface (GUI) for a ball launcher mechanism, according to one embodiment. The ball launcher user interface 401 allows the player to select attributes, such as desired speed and spin of a launched ball 105. According to one embodiment, the ball launcher user interface 401 is coupled with a joystick 402 or a touch screen to control inputs for the ball launcher mechanism 201. In the present example, the four arrows and 25 dots signify the range of speed and spin to choose from. The default speed is initially shown on the display, and it is adjusted by using the up (fast) and down (slow) arrows. The magnitude as well as the direction of spin may selected and applied using the left and right arrows. When the appropriate parameters have been selected, the launch button 501 is pressed to launch a ball 105. The direction of the ball to the left or right of the wicket 108, may be adjusted manually using the control knob 402, or electronically using another DC or stepper motor (not shown).

The selections made on the ball launcher user interface 401 are transmitted to a control circuit. Based on selections, the control circuit calculates the speed and launch angle of a ball 105 and sends appropriate electrical signals to the control board controlling the speed of the motors 453 and the elevation control of the chute 451. In one embodiment, the control circuit of the ball launcher mechanism 201 includes an 8-bit CMOS, Flash-based PIC microcontroller from Microchip Technology, Inc. of Chandler, Ariz.

According to one embodiment, the ball launcher user interface 401 provides a player with options to select the parameters to determine the ball's trajectory. In the embodiment of FIG. 5, the player selects the ball speed and spin. The player may choose different input parameters, for example, the launch angle, the ball length (e.g., the point where the ball first contacts the playing surface), the number of bounces to the wicket 108, and/or the time to reach the wicket 108. Depending on the player's selections, the ball launcher user interface 401 displays different user interfaces for selecting the parameters of the player's choice. Using the player-provided selections, the control circuit determines the launch angle, the speed of the motors 453, and/or other controllable degree of freedom on the ball launcher mechanism 201 to launch a ball with appropriate ball trajectory. In one embodiment, the player selects the ball speed and the ball length, and the launch angle is automatically calculated and determined by the control circuit. If the player selects a slower ball, the launch angle is elevated to maintain the selected ball length. On the other hand, if the player selects a faster ball with the same ball length on the playing surface, the launch angle is lowered as the ball flies faster to make its first bounce at the selected bouncing position.

According to one embodiment, the ball launcher user interface 401 provides an option to select ball attributes from a prescribed recipe (or a look-up table). In another embodiment, the ball launcher mechanism automatically and randomly determines the ball trajectory from an acceptable range of possibilities and provides an additional level of variability and surprise in the game.

Figure 6:
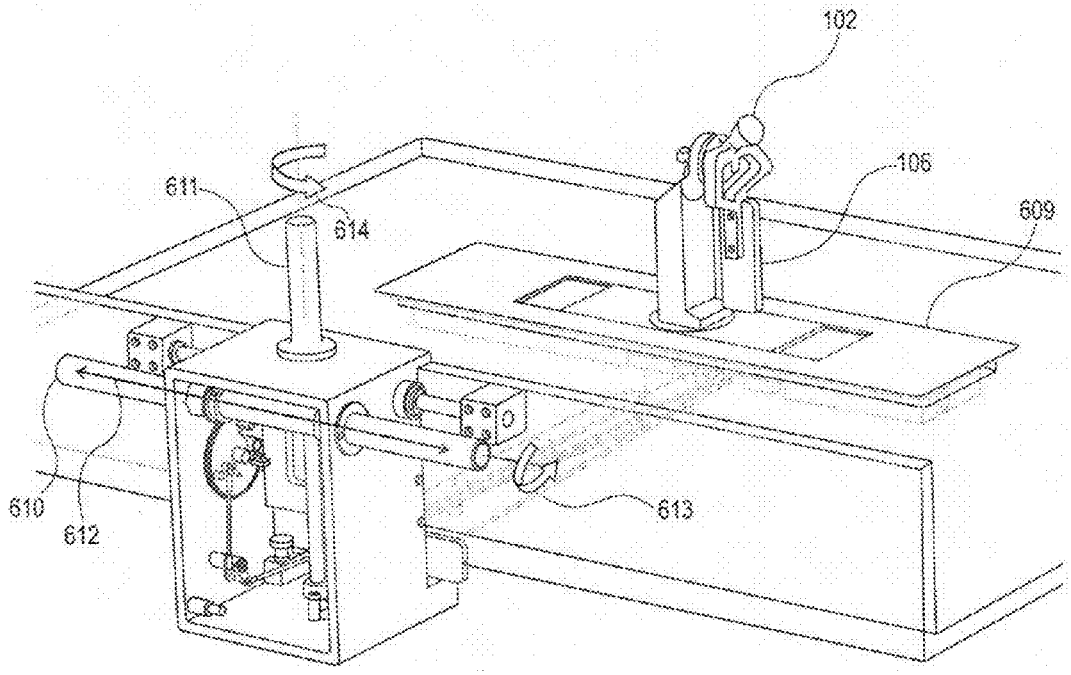
FIG. 6 illustrates an exemplary ball striker mechanism, according to one embodiment.

FIG. 6 illustrates an exemplary ball striker mechanism, according to one embodiment. The batsman 102 is controlled using the batsman control 202. The player places one hand to grasp the rotation handle 611 and another hand on either side of the horizontal handle 610. According to one embodiment, the batsman control 202 provides three degrees of freedom to control the position, angle, and the hitting action of the batsman 102 through gears and mechanical linkages as illustrated in further detail in FIG. 7. The range of motion of the batsman 102 is related to the range of ball trajectories allowed by the ball launcher mechanism 201.

Figure 7:
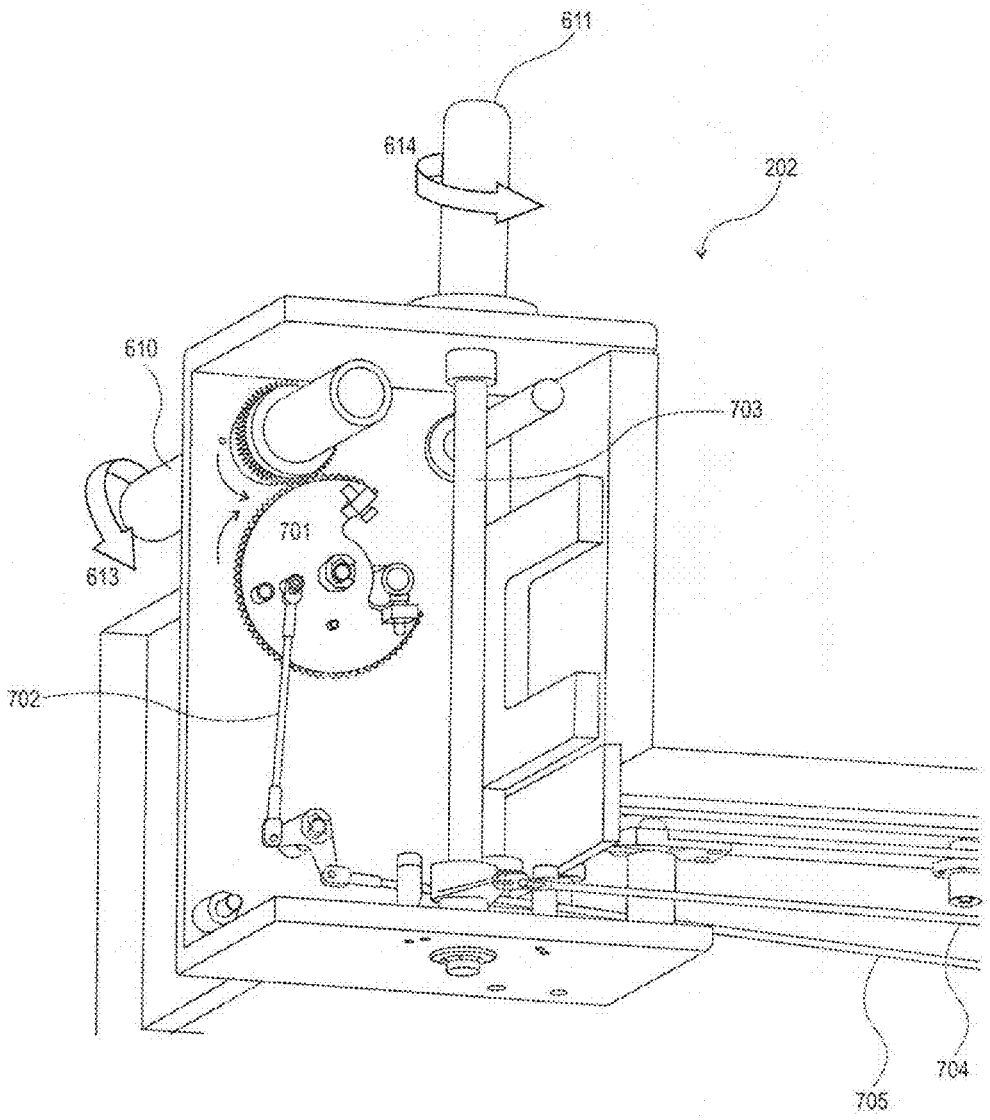
FIG. 7 illustrates details of an exemplary ball striker mechanism, according to one embodiment.

FIG. 7 illustrates details of an exemplary ball striker mechanism, according to one embodiment. The batsman 102 may be made of variety of materials including polypropylene, polyethylene, or acetal to be functional while providing allowing for aesthetic, cost and manufacturability attributes.

The translational motion of the batsman 102 is achieved by a coupling between the batsman control 202 and the batsman 102. As the player slides the batsman control 202 in the direction of 612, the batsman 102 moves left and right along the plate 609. The batsman 102 rotates about a vertical axis to change its standing angle with respect to the ball launcher mechanism 201. The rotational motion of the batsman 102 is achieved by a linkage between the rotation handle 611 and the batsman 102. The rotation of handle 611 about a vertical axis causes the coupled linkage 704 to push or pull, correspondingly rotating the batsman 102 about its vertical axis.

The ball hitting motion or bat swing is achieved via linkages and gears between the horizontal handle 610 and the bat 106. In one embodiment, the bat 106 is attached to the arms and the torso of the batsman 102. To hit the launched ball, the player swiftly turns the horizontal handle 610 in the direction of 613 to swing the bat 106 of the batsman 102.

Figure 8:
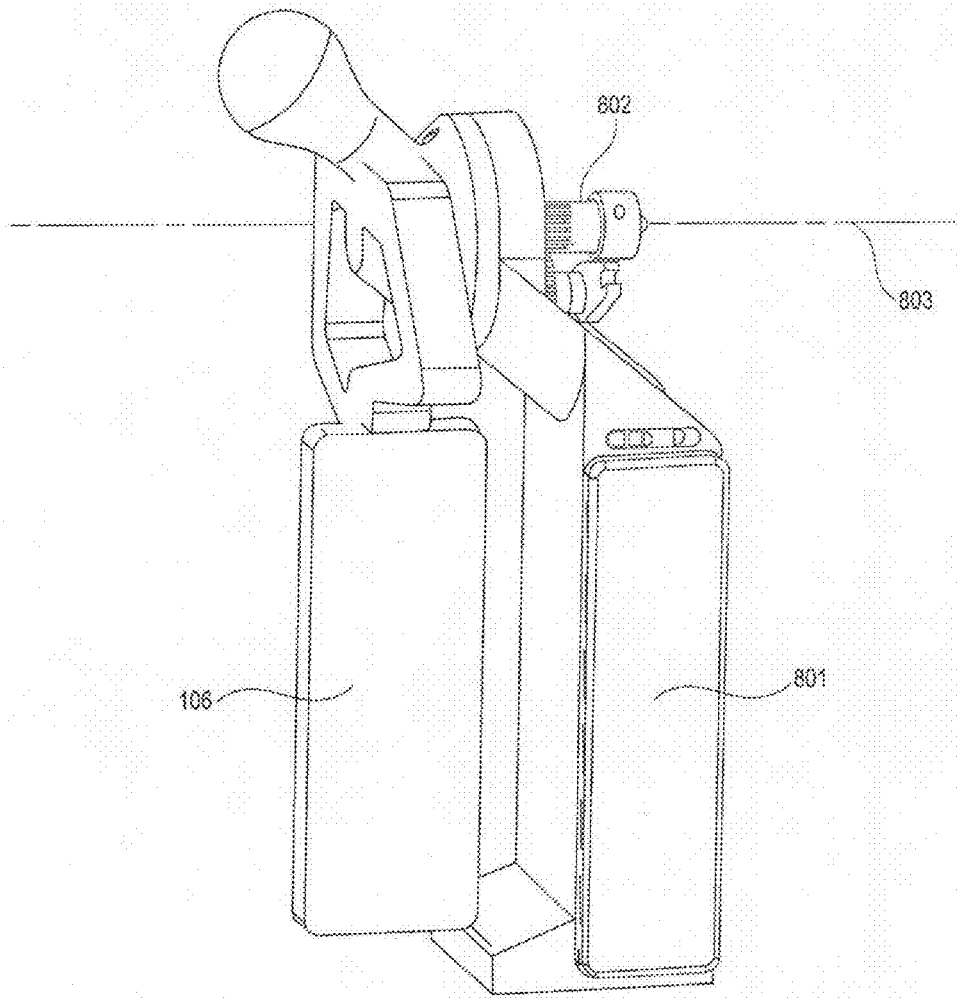
FIG. 8 illustrates an exemplary batsman, according to one embodiment.

FIG. 8 illustrates an exemplary batsman, according to one embodiment. In order to detect mechanical collision of the leg of the batsman 102 with a ball, one or more electrical switches are placed behind the front plate 801 of the batsman 102's leg. When the ball collides with the front panel, an electrical signal is sent to the main computer 160 for data processing. According to one embodiment, the obstruction of the wicket 108 by any part of the batsman 102 is detected by an optical sensor. The light source may be positioned on the ball launcher mechanism 201, and the obstruction of the light may be detected by the optical sensor placed on the wicket 108 at the time when the batsman 102 hits the ball. The same effect can be achieved by swapping the location of the optical sensor and the light source.

According to one embodiment, simple modifications are made to the batsman 102 to resemble other types of ball strikers such as a batter in a baseball or softball game. The linkages and/or gears that actuate the bat 106 are reconfigured to swing the bat 106 substantially parallel to the playing surface. In another embodiment, the batsman 102 may be switched to another ball striker such as a batter in a baseball or softball with the existing linkages and/or gears to play other types of ball games. The fielders 103 may be repositioned on the playing surface and/or substituted with the drains 150. It is appreciated that other modifications, variations, or changes in configuration may be made to play other types of ball games without deviating from the scope of the present subject matter.

According to one embodiment, the batsman 102 is electrically controlled by the batsman control 202 using electrical signals therebetween. The actions of the batsman 102 are accomplished using various electromechanical actuators, for example, servo motors, steppers, or piezoelectric motors.

Figure 9:
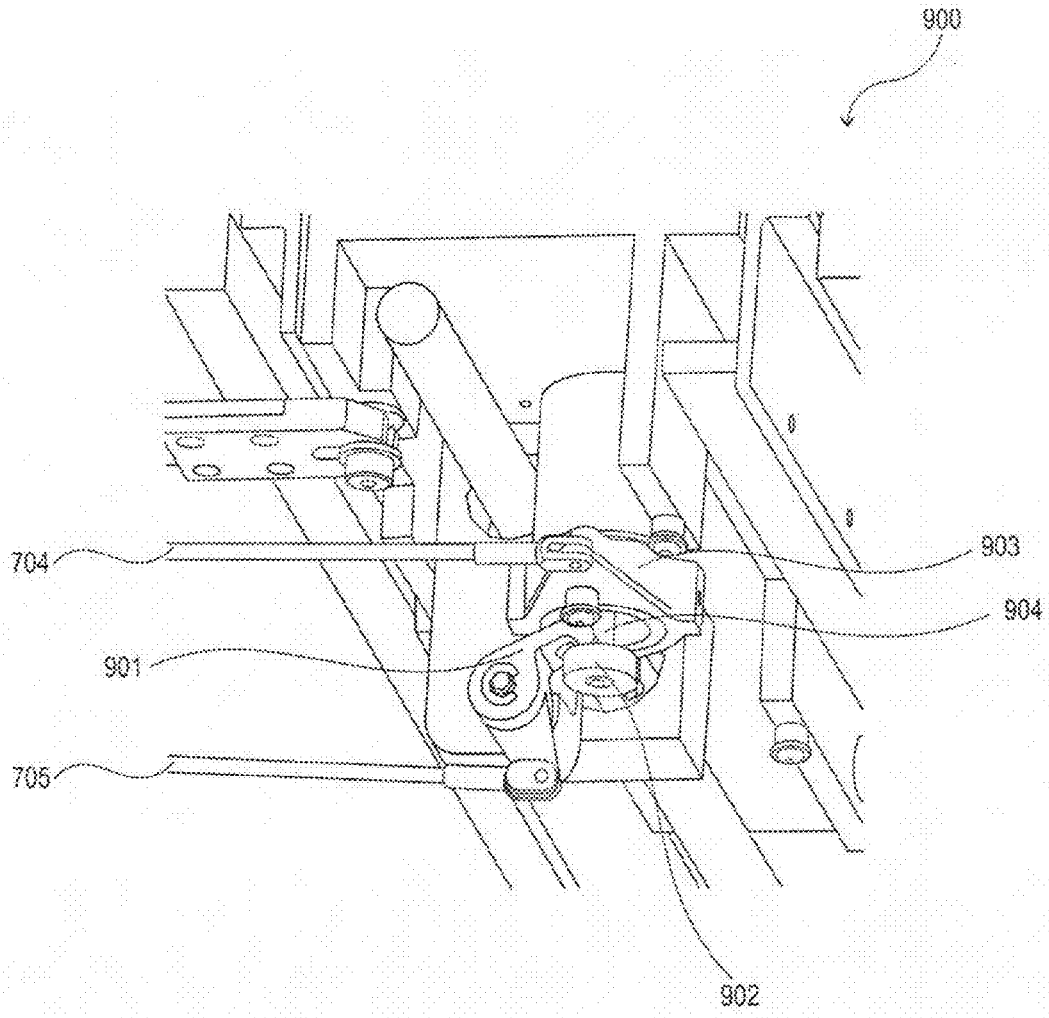
FIG. 9 illustrates an exemplary coupling mechanism between the batsman control and the batsman, according to one embodiment.

FIG. 9 illustrates an exemplary coupling mechanism between the batsman control and the batsman, according to one embodiment. The coupling mechanism 900 is attached to batsman 102 at the bottom below the playing surface of the table game. The turn of the horizontal handle 610 of the batsman control 202 rotates the coupled gear 701 and pushes or pulls the coupled linkages 702 and 705. The translational motion of linkage 705 caused by the turn of the horizontal handle 610 lifts up and down cam 901 to rotate gear 802. The rotation of gear 802 causes the bat 106 to rotate about the axis 803. The faster the player turns the horizontal handle 610, the faster the bat 106 swings. The increased batting speed generally enhances the chance of hitting the ball farther and scoring higher runs.

While the present system has been shown and described herein in what is considered to be the preferred embodiments thereof, illustrating the results and advantages over the prior art obtained through the present invention, the invention is not limited to the specific embodiments described above. Thus, the forms shown and described herein are to be taken as illustrative, and other embodiments may be selected without departing from the spirit and scope of the present subject matter.

Embodiments as described herein have significant advantages over previously developed implementations. As will be apparent to one of ordinary skill in the art, other similar apparatus arrangements are possible within the general scope. The embodiments described above are intended to be exemplary rather than limiting, and the bounds should be determined from the claims.

What is claimed is:

1. A apparatus comprising:

a playing field having a surface;

a ball launcher mechanism launching a ball into the playing field, wherein the ball launcher mechanism allows a first player to adjust a launch angle, a lateral angle and a speed of a ball launched by the ball launcher mechanism, and wherein the ball is not in contact with the surface of the playing field when launched from the ball launcher mechanism and above the surface of the playing field for a significant portion of a trajectory of the ball;

a ball striker mechanism to control a ball striker in a three-dimensional space, wherein the ball striker mechanism has a first control, a second control, and a third control, wherein the ball striker placed at a distance from the ball launcher mechanism in the playing field has a bat to hit the ball launched by the ball launcher mechanism, wherein the first control rotates the ball striker about a vertical axis, wherein the second control adjusts a lateral position of the ball striker, the lateral position of the ball striker being substantially perpendicular to the trajectory of the ball, and wherein the third control swings the bat to hit the ball; and one or more sensors placed in predetermined locations in the playing field and generating electrical signals;

wherein the electrical signals are used to update a status of a game.

2. The apparatus of claim 1 further comprises a processor receiving the electrical signals from the one or more sensors, wherein the processor determines one or more events using the electrical signals provided by the one or more sensors and updates the status of the game.

3. The apparatus of claim 2 further comprising a timer, wherein the processor determines the one or more events within a predetermined time using the timer after the first player launched the ball toward the ball striker.

4. The apparatus of claim 1 further comprising one or more displays, wherein the status of the game is updated on the one or more displays.

5. The apparatus of claim 4, wherein the one or more displays provide video effects when the one or more events occur.

6. The apparatus of claim 1, wherein the ball launcher mechanism comprises:

a chute with an adjustable angle; and at least two wheels, each of the at least two wheels coupled to a motor, wherein the ball is fed to the chute while the at least two wheels are spinning at a speed determined by the processor.

7. The apparatus of claim 6, wherein the launch speed of the bail is determined by the speed of the at least two wheels.

8. The apparatus of claim 6, wherein the speed of the at least two wheels is independently controlled by the processor.

9. The apparatus of claim 8, wherein speed differential of the at least two wheels generates a spin of the ball when launched.

10. The apparatus of claim 6, wherein the ball launcher mechanism further comprises a directional adjustor that adjusts the direction of the ball when launched.

11. The apparatus of claim 1, wherein the playing field comprises a pitch area, an outer field, and a perimeter area.

12. The apparatus of claim 1 further comprising one or more drains.

13. The apparatus of claim 1, wherein the apparatus is a cricket game.

14. The apparatus of claim 13 further comprises a wicket-keeper and a wicket placed between the ball striker and the wicketkeeper.

15. The apparatus of claim 1, wherein the apparatus is a baseball or a softball game.

16. The apparatus of claim 1 further comprising one or more fielders located along a perimeter area to intercept the ball.

17. The apparatus of claim 16, wherein each of the one or more fielders is translated using a fielder control.

18. The apparatus of claim 16, wherein each of the one or more fielders comprises arms and a ball feeder.

19. The apparatus of claim 18, wherein the ball caught by the arms of the one or more fielders is fed through the ball feeder to the ball launcher mechanism.

20. The apparatus of claim 18, wherein each of the one or more fielders further comprises a ball detection sensor, and wherein the ball detection sensor delivers an electrical signal to the processor when detecting the ball.

21. The apparatus of claim 1 further comprises one or more speakers for providing audio effects when the one or more events occur.

22. The apparatus of claim 1, wherein the the first player adjusts a spin of the ball.

23. The apparatus of claim 1, wherein the ball is launched in the air and flies over a partial distance between the ball launcher mechanism and the ball striker mechanism.

24. The apparatus of claim 1, wherein the processor communicates with a server to transmit information regarding the one or more events.

25. The apparatus of claim 1, wherein the processor communicates with a server to receive information from the server.

* * * * *

UNITED STATES PATENT AND TRADEMARK OFFICE

CERTIFICATE OF CORRECTION

PATENT NO. : 8,360,435 B2
APPLICATION NO. : 12/630736
DATED : January 29, 2013
INVENTOR(S) : Aditya Dayal et al.

It is certified that error appears in the above-identified patent and that said Letters Patent is hereby corrected as shown below:

In the drawings: On sheet 3 of 9, in Fig. 3, reference numeral 302, delete "BALL HITS BALL?" and insert -- BATSMAN HITS BALL? --.

In the drawings: On sheet 3 of 9, in Fig. 3, reference numeral 304, delete "BATSMAN HITS WICKET?" and insert -- BALL HITS WICKET? --.

Signed and Sealed this
Twenty-third Day of April, 2013

Teresa Stanek Rea
*Acting Director of the United States Patent and Trademark Office*